United States Patent [19]

Roser

[11] 4,325,285

[45] Apr. 20, 1982

[54] COMPRESSED AIR MOTOR

[75] Inventor: Erich Roser, Friedrichshafen, Fed. Rep. of Germany

[73] Assignee: Rudolf Hübner GmbH & Co., Fed. Rep. of Germany

[21] Appl. No.: 108,040

[22] Filed: Dec. 28, 1979

[51] Int. Cl.[3] ..... F01L 23/00; F01L 31/02

[52] U.S. Cl. ..... 91/341 R; 91/346; 91/466

[58] Field of Search ..... 91/346, 347, 341 R

[56] References Cited

U.S. PATENT DOCUMENTS

| | | | |
|---|---|---|---|
| 203,801 | 5/1878 | Darrow et al. | 91/346 |
| 2,638,877 | 5/1953 | Emig | 91/347 |
| 2,707,941 | 5/1955 | Hordy | 91/347 |
| 2,808,815 | 10/1957 | Cromwell | 91/346 |

FOREIGN PATENT DOCUMENTS

| | | | |
|---|---|---|---|
| 2816617 | 10/1979 | Fed. Rep. of Germany | 91/346 |

*Primary Examiner*—Paul E. Maslousky
*Attorney, Agent, or Firm*—McGlew and Tuttle

[57] ABSTRACT

A compressed air motor comprises a cylinder with a piston slidable in said cylinder and connected to a compressed air inlet through a slide valve mechanism which alternately admits respective opposite sides of the cylinder with compressed air for driving the piston in the opposite direction, and which also alternately vents the side of the cylinder in which the piston is moving. The construction includes an action rod mounted for movement in a direction parallel to the piston on each side thereof which is contacted by the piston after predetermined movement thereof. A snap-action lever mechanism is connected between the action rod and the slide valve mechanism so that the action rod, through the snap-action lever mechanism reverses the slide valve during each motion of the piston. The action rod member is returned to its starting position during the return movement of the piston by means of a stop member connected to an extension of the piston.

8 Claims, 1 Drawing Figure

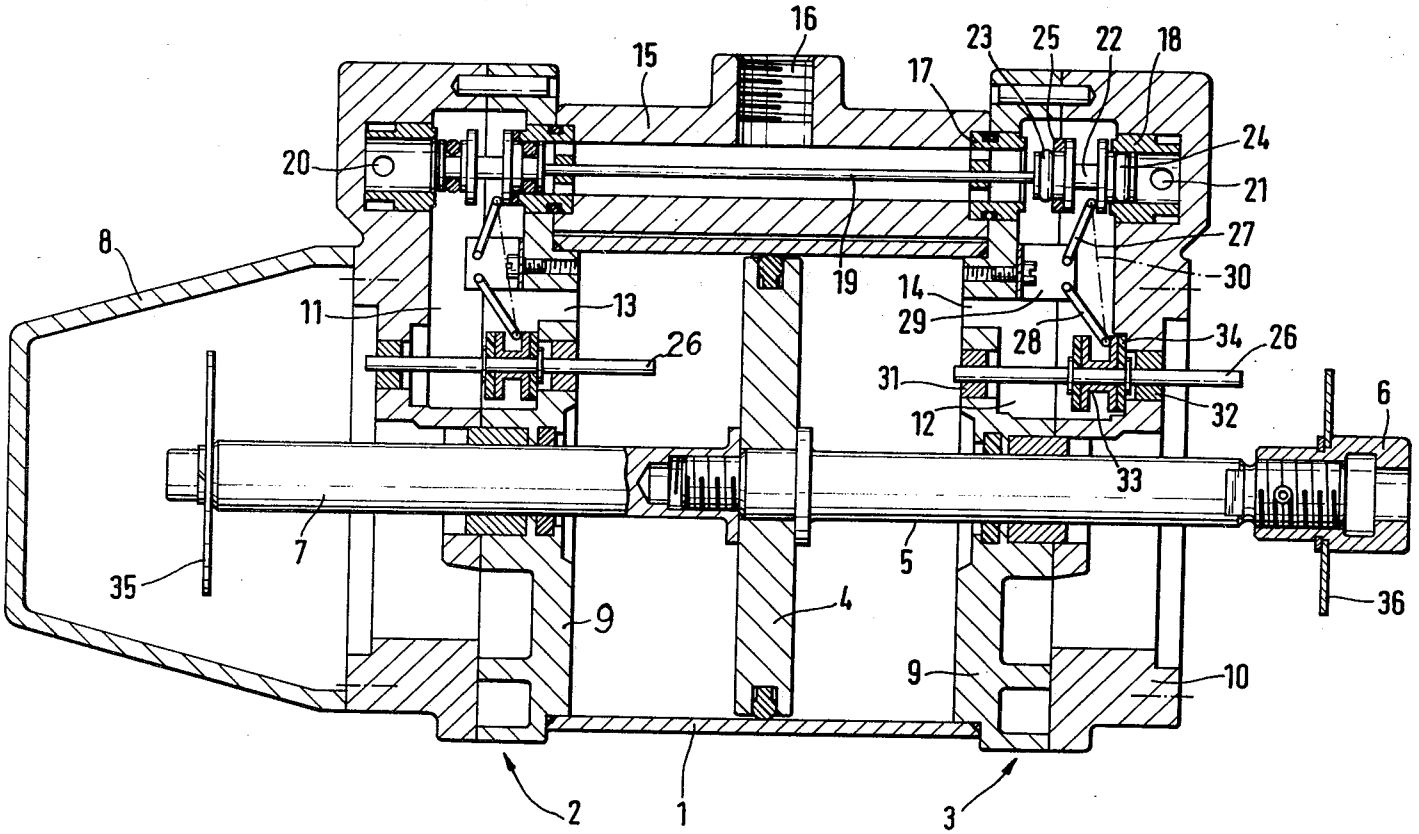
6
36
26
24
21
27
30
34
32
10
18
22
33
25
28
23
3
17
14
29
31
12
5
9
19
4
16
1
26
15
13
9
2
20
11
7
8
35

COMPRESSED AIR MOTOR

FIELD AND BACKGROUND OF THE INVENTION

This invention relates to compressed air motors in general and, in particular to a new and useful motor having improved means for reversing the compressed air drive of a slidable piston.

More specifically, the invention relates to a compressed air motor, comprising, a cylinder, an axially movable piston, a piston rod, and a piston slide valve which is disposed parallel to the cylinder and reverses the compressed drive air and is in actuating connection with the piston by means of a snap-action device.

One known compressed air motor of this kind is intended to drive a double-acting piston pump as part of a high pressure paint sprayer. Its snap-action device comprises a control rod which penetrates the piston, protrudes into the hollow piston rod and has a perpendicularly projecting drive arm actuating the piston slide valve. The snap-action is obtained by means of two radially spring-loaded snap slides, below which, rollers, mounted to the driver, pass.

A disadvantage of this complicated design, among others, is that compressed air motors of different displacement in one type series almost always require special components suited to the particular motor type. Moreover, for larger piston diameters, the driver arm is particularly unfavorable because the friction losses caused by bending deformations increase beyond proportion as the driver's overhand, i.e., the piston diameter, increases.

SUMMARY OF THE INVENTION

The present invention provides a reliably working compressed air motor which can be produced economically in different displacement variations and is suited for larger piston diameters starting at about 70 mm in particular.

According to the invention, starting from a compressed air motor of the kind described in detail at the outset, this problem is solved in that an action rod is provided which is mounted so as to be movable lengthwise parallel to the piston rod and it actuates the snap-action device, penetrates the face of the cylinder, and is pushed back and forth alternately by the piston and a stop fastened outside of the cylinder to the piston rod.

This action rod, which performs a short stroke shortly before each piston reversal, need not be modified for a longer cylinder and a piston performing a correspondingly longer stroke. If the action rod is mounted between the piston rod and the piston slide valve, this will decrease the radial distance which must be bridged by the snap-action devices. Basically, therefore, the same reversing mechanisms can be used in compressed air motors of different piston diameters and different stroke lengths.

In a further development of the invention, it is proposed that the snap-action device consist of two single-arm levers facing away from each other, whose ends engage the piston slide valve and the action rod and are interconnected by at least one extension spring. Such an arrangement has the advantage of requiring particularly small actuating forces. Further, a relatively thin and lightweight action and design can contribute to this. The lever ends need only contact radial surfaces of the piston slide valve and action rod so that these two moving parts are not stressed axially at all, and are thus freely movable.

A further advantage of only having to exert a very little force in order to actuate the piston slide valve by snap-action is that the piston barely slows down prior to reversal so that no noticeable pressure drop occurs, resulting in a uniform, rather than pulsating, sprayed paint jet.

If the action rod guide bearing in the cylinder face consists of air-permeable sintered bronze or has a clearance, compressed air from the respective cylinder chamber could escape through this bearing. To prevent this, it is proposed that the single action road have an axial seal mountable on the inside to seal its guide hole. This arrangement should be such that the action rod is in the end position in which the seal is effective as long as the associated cylinder chamber in under pressure.

Another further development of the invention consists in that the piston rod projects on both faces out of the cylinder and that a mirror-image arrangement of two identically acting action rods and snap-action devices are provided, i.e., one action rod and one snap-action device each at each cylinder face end. Such a dual arrangement is particularly advantageous because identical parts can be used. In addition, the pressures acting upon the piston in both directions of motion can be balanced against each other exactly by such an arrangement so that the piston moves at the same speed in both directions. This effects another improvement of the spray pattern. The two snap-action devices require only a rough adjustment because, actionwise, they are interconnected through the piston slide valve. Therefore, when one dual lever reverses shortly before the other, it takes the latter along, so that all extension springs always become effective at the same time.

Accordingly, an object of the present invention is to provide a compressed air motor which comprises a cylinder, and a piston slidable in the cylinder which is actuated by compressed air fed through an inlet and a slide valve to respective sides of the piston for effecting a movement in the opposite direction and which also includes means for venting the cylinder in the direction of movement of the piston, the construction including an action rod which is moved by the piston after it moves by a predetermined distance and acts on a snap-action lever mechanism to shift the slide valve to change it over to a reversing direction in which the compressed air is directed to the opposite side of the cylinder and which further includes means for returning the action rod to an initial position after each cycle of movement.

A further object of the invention is to provide a compressed air motor which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

The only FIGURE of the drawing is an axial sectional view of a compressed air motor constructed in accordance with the present invention.

DESCRIPTION OF THE PREFERRED EMBODIMENT

Referring to the drawing in particular, the invention embodied therein, comprises, a compressed air motor which has a slide valve mechanism which is actuated by the movement of a piston 4 in a cylinder 1. The compressed air motor shown in the drawing comprises a cylinder or tube 1 and cylinder head means at each end of the cylinder comprising two identical, symmetrically arranged cylinder heads 2 and 3. A piston 4 moves in the cylinder tube and has a piston rod portion 5 which projects to the right and carries a coupling 6 at its end, by means of which, the piston rod of a double-acting high-pressure paint spray pump can be connected. A piston rod extension or opposite piston rod portion 7 of the same section penetrates the left cylinder head 2. The protruding end is covered by a cap 8 which offers adequate room for motion.

Each of the cylinder heads 2 and 3 consists of an internal part 9 and an external part 10, which are screwed together, and form antechambers 11 and 12 which communicate with the respective cylinder chambers through openings 13 and 14, respectively. A connecting part 15 is inserted outside of the cylinder tube 1, between the internal parts 9. Connecting part 15 has a central, longitudinal bore and an air inlet nipple 16 in the middle.

A piston slide valve is inserted in the connecting part 15 and the cylinder heads 2 and 3 and is also of a symmetrical design. The slide valve comprises two inner sleeves 17 and two outer sleeves 18. The inner sleeves 17 have a severally perforated radial wall in which a valve stem 19 is mounted. The outer sleeves 18 show radial holes 20 and 21, respectively, communicating with the outside air through canals, which are not visible in the drawing. A valve piston 22 is fastened to both ends of the valve stem 19. The central part of each valve stem 19 is H-shaped in the longitudinal section. Each end section carries an O-ring 23 and 24. The outer diameter of these O-rings fits the inner sleeve 17 or outer sleeve 18 and alternatingly seals them. Moreover, each side of the valve pistons facing the valve center carries a stop ring 25 of an elastic material which makes contact with the respective face of the inner sleeve 17, thereby limiting on both sides, the stroke of the piston slide valve, consisting of the valve stem 19 and the valve pistons 22.

The snap-action mechanism for the actuation of the piston slide valve comprises two likewise mirror-image arrangements accommodated in the antechambers 11 and 12. They each include an action rod 26 and a dual lever arrangement, with the latter, in turn, comprising two snap levers 27 and 28. These snap levers are of rectangular U-shape, not shown in the drawing, with leg ends bent outwardly at right angles. The leg ends are rotatably mounted as bearing pins in the legs of a sheet metal bearing 29 bent into a U-shape configuration. The bearing 29 is screwed to the respective internal part 9. The mutually opposed snap levers 27 and 28, thus being freely rotatable, are connected to each other at their ends by two extension springs 30 indicated by dash-dotted lines.

The action rod 26 is mounted parallel to the piston rod 5 in sintered bronze bearings 31 and 32 inserted in the internal part 9 and external part 10, respectively. A sheave 33, which is H-shaped in the longitudinal section, is disposed in the middle of the action rod 26 and is fastened, together with a gasket 34 on each side, by means of two retaining rings. The gaskets comprise an elastic material and also serve the elastic stroke limitation of the action rod 26. The action rods 26 are actuated directly by the piston 4, on the one hand, and by two stop plates 35 and 36 on the other hand, which are gastened to the left end of the extension 7 and to the coupling 6, respectively, i.e., to the right end of the piston rod 5.

The center webs of the crank-like snap levers 27 and 28 tangentially engage the indentations in the valve piston 22 and sheave 33 on the action rod 26, respectively. It should be noted that these center webs are so long that the two extension springs 30 anchored to them have sufficient room on both sides of the valve piston 22 and sheave 33.

The compressed air motor of the invention operates as follows:

Starting from the position shown in the drawing, the compressed air entering through the air inlet nipple 16 passes through the central bore of the connecting part 15 and the opened right inner sleeve 17, reaching the right antechamber 12, and the right cylinder chamber through the opening 14, so that the piston is driven to the left.

The right O-ring 24 on the right valve piston 22 closes the outer sleeve 18. Since the gasket 34 to the right of the sheave 33 on the action rod 26 rests against the external part 10, no air can escape through the sintered bronze bearing 32 either. The connection between the air inlet nipple 16 and the antechamber 11 is blocked on the left cylinder head 2. The air in the left cylinder chamber escapes through the opening 13, and the antechamber 11, and the holes 20 in the outer sleeve 18 are thus opened.

Finally, during the stroke directed to the left, the piston 4 strikes the left action rod 26, and the stop plate 36 strikes the right action rod 26. From then on, both action rods are taken along to the left, whereby, the two lower snap levers 28 are caused to swing to the left. This causes the extension springs 30 to extend. The pulling forces acting upon the upper snap levers 27 change their direction until, finally, the snap levers of each pair lie in one line, i.e., the center axes of the extension springs 30 intersect the bearing axes of the upper snap levers 27. If the action rods now continue to move just a little bit more, the snap motion sets in. One of the two upper snap levers 27 snaps to the left, and, if the other upper snap lever 27 does not perform the same motion at the same instant, the light tap exerted on the piston slide valve by the leading upper snap lever is sufficient to make the other upper snap lever follow immediately.

The piston slide valve is thereby moved by spring force into its left position, defined by the stop ring 25 of the right valve piston making contact with the face of the right inner sleeve 17. In addition, both action rods 26 are taken along into their left end positions by the lower snap levers 28, with the gasket 34 on the left action rod sealing the associated outer sintered bronze bearing 32. The compressed air now flows through the left antechamber 11 into the left cylinder chamber and drives the piston to the right. The air in the right cylinder chamber escapes through the right antechamber 12 and the holes 21.

While a specific embodiment of the invention has been shown and described in detail to illustrate the application of the principles of the invention, it will be understood that the invention may be embodied otherwise without departing from such principles.

What is claimed is:

1. A compressed air motor, comprising, a cylinder, a piston slidable in said cylinder, a compressed air inlet to said cylinder, a slide valve mechanism connected between said compressed air inlet and each end of said cylinder for admitting air to respective ends of said cylinder for driving said piston in respective directions and for venting the side of said cylinder in front of the direction of movement of said piston, an action rod disposed in the path of said piston on each end of said cylinder and being movable by said piston upon a predetermined movement of said piston, a snap lever mechanism connected between each action rod and said slide valve mechanism and acting on said slide valve mechanism upon movement of said action rod to reverse said slide valve mechanism after the predetermined movement of said piston, and means connected to said piston to move each said action rod back to an initial position upon return movement of said piston.

2. A compressed air motor, as claimed in claim 1, wherein each snap lever mechanism comprises two single-arm levers mounted adjacent each end of said cylinder, said levers extending away from each other, one of said two levers having an end which engages said slide valve and the other of said two levers having an end which engages said action rod, said snap lever mechanism including an extension spring connected between said lever ends.

3. A compressed air motor, as claimed in claim 1, including bearing bushing means mounted in an opening in each end of said cylinder, an action rod slidable in each of said bearing bushing means respectively, and a sealing member carried by each of said action rods and cooperating with said respective opening to seal said respective bushing means at the end of said cylinder which is pressurized during each cycle.

4. A compressed air motor, as claimed in claim 1, wherein said piston has a piston rod with a portion projecting from each end of said piston, said action rods being mounted at each end of said cylinder, the action rod on one end being substantially identical to that on the opposite end, and said means connected to said piston to move each action rod back to an initial position comprising a stop member connected to each end of said piston rod.

5. A compressed air motor comprising a cylinder, a piston movable in said cylinder, a slide valve having a central compressed air inlet and a valve stem chamber connected to said inlet having an opening at each end, said slide valve having a stem portion in said stem chamber and a respective valve piston at each end located so that in one end position of said slide valve one valve piston opens one end of said slide valve stem chamber, and the other closes the opposite end of said slide valve stem chamber and, in an opposite end position, the one end closes said one end of said slide valve stem chamber and the opposite end closes the opposite end of said chamber, cylinder head means at respective ends of said cylinder defining a respective passage from an end of said stem chamber to a respective end of said cylinder so as to communicate compressed air from said air inlet to said respective end so that the air acts on said piston and moves said piston away from said respective end, an action rod mounted on each of said cylinder head means for axial movement parallel to said piston and located in the path of said piston so as to be moved thereby in the same direction of movement as said piston, snap-lever means mounted on each of said head means and engaged with a respective action rod and said valve piston and being effective to move said valve piston and said stem to shift said slide valve to an opposite end position, and means connected to said piston to return each action rod during return movement of said piston.

6. A compressed air motor, as claimed in claim 5, wherein each of said head means includes a sintered bearing mounting each action rod, each action rod having a member closing its bearing to the outside of said motor when the respective end of said cylinder is pressurized.

7. A compressed air motor, as claimed in claim 6, wherein each of said head means includes a chamber therein accommodating its action rod and which is communicated by said slide valve to the atmosphere for venting the end of the cylinder ahead of said piston.

8. A compressed air motor as claimed in claim 5, wherein each valve piston and each action rod includes a portion which is of substantially H-shaped configuration in a longitudinal direction, each snap-lever means including first and second snap lever arms, each arm having a leg portion engaged in an H-shaped portion of a respective slide valve and a respective action rod, and an extension spring connecting outer ends of said leg portions together.

* * * * *